United States Patent [19]

Fukuda et al.

[11] 4,452,537

[45] Jun. 5, 1984

[54] ALARM SETTING APPARATUS FOR TIMEPIECES

[75] Inventors: Masao Fukuda; Etsuo Nakada, both of Saitama, Japan

[73] Assignee: Rhythm Watch Co., Ltd., Tokyo, Japan

[21] Appl. No.: 444,728

[22] Filed: Nov. 26, 1982

[30] Foreign Application Priority Data

Nov. 30, 1981 [JP] Japan ..... 56-179013[U]
Oct. 26, 1982 [JP] Japan ..... 57-162265[U]
Oct. 29, 1982 [JP] Japan ..... 57-164310[U]

[51] Int. Cl.[3] ..... G04B 23/02; G04B 21/00
[52] U.S. Cl. ..... 368/74; 368/269
[58] Field of Search ..... 368/72–74, 368/76, 80, 99, 185, 190, 243–244, 250, 269, 315

[56] References Cited

U.S. PATENT DOCUMENTS 4,000,384 12/1976 Kumazawa ..... 368/250
4,069,658 1/1978 Ito ..... 368/244
4,427,301 1/1984 Cleusix ..... 368/72

FOREIGN PATENT DOCUMENTS 2336579 2/1974 Fed. Rep. of Germany ..... 368/269
55-154692 11/1980 Japan ..... 368/269
56-148082 11/1981 Japan ..... 368/269

*Primary Examiner*—Vit W. Miska
*Attorney, Agent, or Firm*—Koda and Androlia

[57] ABSTRACT

An alarm setting device for a timepiece that can be operated by means of an axle for adjusting the alarm setting wheel, by rotating it in a clockwise and a counterclockwise directions. The device includes an alarm setting wheel, an alarm intermediate wheel, and an alarm setting cam, all disposed coaxially. The alarm setting wheel is rotated and adjusted by the alarm setting wheel adjusting axle. The alarm intermediate wheel rotates together with a wheel train of a timepiece. The alarm setting cam is provided between said alarm setting wheel and alarm intermediate wheel. A protrusion provided in the alarm setting cam engages with a loose joint provided in the alarm intermediate wheel. Through this engagement, the alarm intermediate wheel drives the alarm setting cam by dragging it loosely. On the respectively facing surfaces of the alarm setting cam and the alarm setting wheel, either an alarm finger or an engaging portion is provided, respectively. Either the alarm finger or the engaging portion has a sloped depression surface and a sloped shoulder, thereby making it possible to perform alarm setting in reciprocal directions.

5 Claims, 25 Drawing Figures

ALARM SETTING APPARATUS FOR TIMEPIECES

BACKGROUND OF THE INVENTION

1. Field of the Invention

The present invention relates to an alarm setting device, and particularly to an alarm setting device that is capable of adjusting the alarm setting time by rotating in a clockwise as well as a counterclockwise direction of an axle for adjusting the alarm setting wheel.

2. Prior Art

Alarm setting devices which can be operated by reciprocal rotation of the axle for adjusting the alarm setting wheel to adjust the alarm setting time have been known generally. For example, such a type of alarm setting device is proposed in Japanese Laid-Open Patent Application No. 53-11816. That is, in an alarm setting mechanism wherein an hour hand wheel and an alarm setting wheel are disposed coaxially, an engaging portion of the alarm setting wheel is provided with a sloped depression surface and a sloped shoulder to engage a projection of the hour hand wheel. Also, between the alarm setting wheel and the hour hand wheel, an alarm setting cam is disposed. This alarm setting cam can be made to swing back and forth through a predetermined angle. Furthermore, a finger of the alarm setting cam is always positioned on the engaging portion of the alarm setting wheel by an elastic arm that is combined with the alarm setting wheel to form a single body.

Then, when the hour hand wheel rotates clockwise, the protrusion of the hour hand wheel drops into the engaging portion of the alarm intermediate wheel from a position on a finger of the alarm setting cam. Thereafter, when this protrusion rises due to the slope of the alarm setting wheel, the desired alarm setting operation is performed. On the other hand, when the hour hand wheel rotates reversely wherein the protrusion of the hour hand wheel is depressed into the engaging portion of the alarm setting wheel, the vertical surface of the protrusion of the hour hand wheel presses and moves the finger of the alarm setting cam. By doing so, the protrusion rises up the slope of the engaging portion of the alarm intermediate wheel.

However, this alarm setting mechanism requires an extremely complicated structure including installation of an elastic arm in the alarm setting wheel and thereby pushes the cost of manufacturing up. In addition, in such conventional types of alarm setting devices for timepieces, the elastic arm is combined with the alarm setting wheel to form a single unit. Therefore, as a result of use over a long period of time, elastic deformation of the elastic arm occurs which results in a disturbance in the swinging motion of the alarm setting cam. As a result, it occurs that the finger of the alarm setting cam does not reach to the position on the engaging portion of the alarm intermediate wheel upon alarm setting time with the result that the alarm setting precision is lowered.

SUMMARY OF THE INVENTION

Accordingly, it is the general object of the present invention to obviate the disadvantages accompanying the prior art and to provide an alarm setting device with which the alarm setting time can be adjusted through the reciprocal rotation of an axle.

Another object of the present invention is to provide an alarm setting device which is durable and retains its precision over a long period of use.

It is still another object of the present invention to provide an alarm setting device with a simple structure and lower manufacturing cost.

The above mentioned objects of this invention are achieved by providing an alarm setting device which includes an alarm intermediate wheel that is provided in a wheel train of a timepiece and that is interlocked with the time hands, an alarm setting wheel that is held by a main plate coaxial with the alarm intermediate wheel in a freely rotatable manner and which functions to set the alarm triggering time, an alarm setting cam provided between the alarm intermediate wheel and the alarm setting wheel coaxial therewith and which rotates by being drawn loosely by the alarm intermediate wheel while also moves freely in the axial direction and an energizing spring to press the alarm setting cam towards the alarm setting wheel.

The above described basic elements of the alarm setting device of the present invention further include two protrusions on the alarm setting cam facing towards the alarm intermediate wheel and at least one alarm finger or engaging portion provided on the alarm setting cam facing towards the alarm setting wheel. The alarm intermediate wheel is further provided with at least one loose joint on its side facing towards the alarm setting cam. This loose joint is to engage with the protrusion of the alarm setting cam. Also, this loose joint is formed to be longer in the circumferential direction than the protrusion of the alarm setting cam. This construction is provided in order to drag the alarm setting cam loosely to cause it to rotate. This in turn makes it possible for the protrusion to rotate for a predetermined extent in the circumferential direction within the loose joint. At least two engaging portions or alarm fingers engaging with the alarm fingers or engaging portions of the alarm setting cam to move in the axial direction during the alarming operation are provided.

Either the alarm fingers or the engaging portions formed on the mutual facing sides of the alarm setting cam and the alarm setting wheel are each provided with a sloped depression and a sloped shoulder. Therefore, the alarm setting operation in the clockwise direction as well as the counterclockwise direction is possible.

Also, either at a location adjacent to the depression on top of the alarm finger or at the location adjacent to the depression of the engaging portion that corresponds to the foregoing alarm finger, a projection is formed. At one of these locations, which is not provided with the aforesaid projection, a recess is provided. This recess is for engaging with the foregoing projection. Upon engagement between this projection and the recess, the protrusion of the alarm setting cam is pressed against a wall surface of the loose joint of the alarm intermediate wheel. As a result, the alarm intermediate wheel and the alarm setting cam are securely joined at the time of alarming operation. Thus, accurate alarm setting can be achieved.

DETAILED DESCRIPTION OF THE INVENTION

Figure 1:
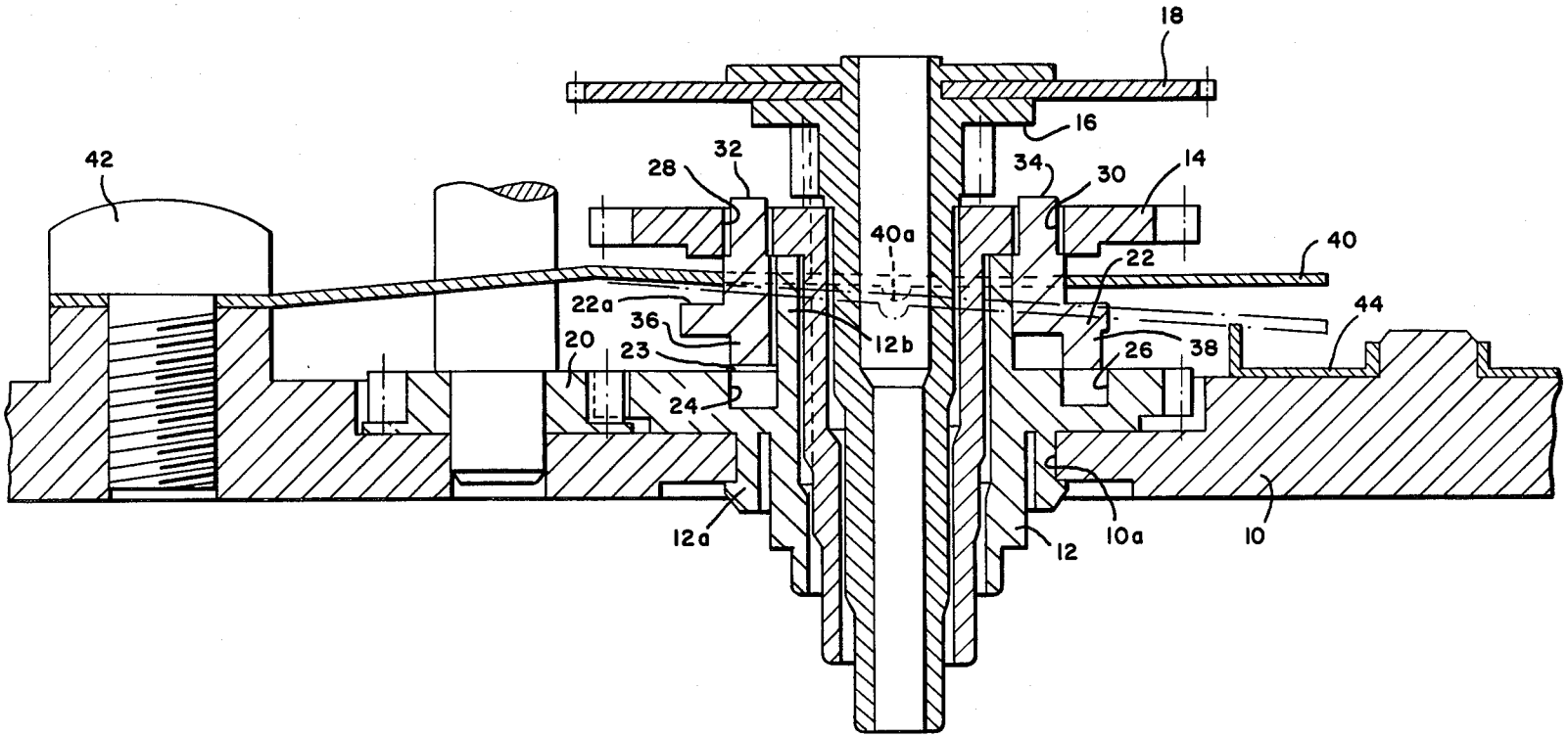
FIG. 1 is a sectional view illustrating the essential portions of a first embodiment of an alarm setting device in accordance with the teachings of the present invention.

FIG. 1 is a sectional view showing a first preferred embodiment of an alarm setting device in accordance with the teachings of the present invention. To the main plate 10 of the timepiece, an alarm setting wheel 12 which forms the alarm setting wheel of the present invention is rotatably coupled. The alarm setting wheel 12 is provided with an elastic, split type ring 12*a* that is combined with the alarm setting wheel 12 in a single plastic body. The split type ring 12*a* is connected to the main plate 10 fitted through an open hole 10*a* in the main plate 10. In the inner circumference of the alarm setting wheel 12, an hour hand wheel 14 that forms an alarm intermediate wheel of this invention is axially and rotatably supported. Furthermore, in the inner circumference of the hour hand wheel 14*a*, a minute hand wheel 16 is axially and rotatably held. To the minute hand wheel 16, a minute hand gear 18 is frictionally combined. The minute hand wheel 16 and the hour hand wheel 14, while not shown in the figures, engage with a known wheel train of a timepiece, and are rotatably driven at a specified speed by an output from a time reference source. Also, the alarm wheel 12 is rotatably driven by an alarm knob through an alarm pinion 20.

Figure 2:
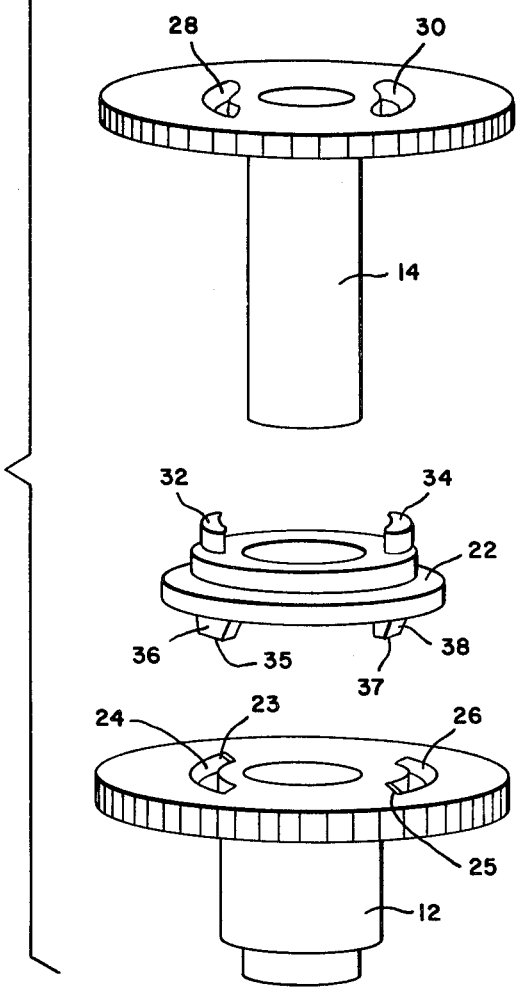
FIG. 2 is an exploded perspective view of the portions of FIG. 1.
Figure 3:
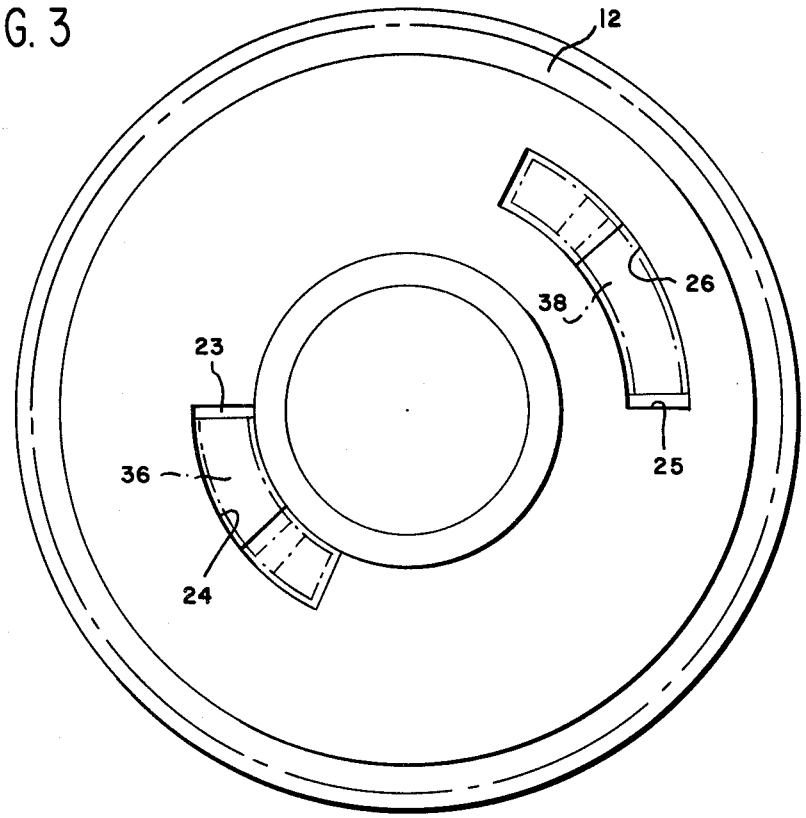
FIG. 3 is a plan view illustrating alarm setting wheel of FIG. 1.
Figure 4:
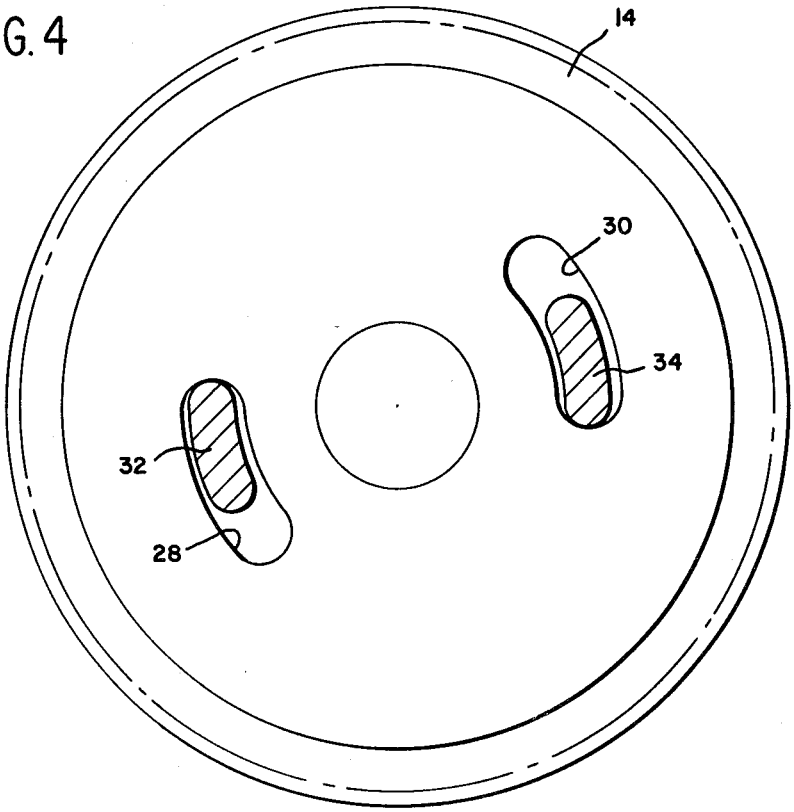
FIG. 4 is a plan view illustrating an hour hand wheel of FIG. 1.

The alarm wheel 12 has a bearing wheel 12*b* that projects from one end of the alarm wheel 12. The hour hand wheel 14 is controlled in its axial movement by bearing on the ring 12*b*. Between the alarm setting wheel 12 and hour hand wheel 14, an alarm setting cam 22 is provided. The alarm setting wheel 12, the alarm setting cam 22 and the hour hand wheel 14 are shown in detail in the sectional view of FIG. 2. Also, in FIGS. 3 and 4, plan views of the alarm setting wheel 12 and the hour hand wheel 14 are shown, respectively.

In the gear face of the alarm setting wheel 12, engaging areas 24 and 26 are provided. These engaging areas 24 and 26 are in the form of long grooves which extend along the circumferential direction and which are located at respectively different radial positions. At locations nearby the engaging areas 24 and 26, projections 23 and 25 are provided in a protruding manner. In a similar manner, the hour hand wheel 14 is provided with two loose joining areas 28 and 30 which are made of two long grooves, respectively. On the surface of one end of the alarm setting cam, two projections 32 and 34 which loosely join with the loose joining areas 28 and 30 of the hour hand wheel 14 are provided. Also, on the surface of the other end of the alarm setting cam 22, alarm fingers 36 and 38 which engage with the engaging areas 24 and 26 of the alarm setting wheel 12 are provided and form a single body with the alarm setting wheel 22. The protrusions 32 and 34 of the alarm setting cam 22 are shorter in length along the circumferential direction than the loose joining areas 28 and 30 of the hour hand wheel 14. Accordingly, it is possible for the alarm setting cam to rotate reciprocally for a predetermined amount along the circumferential direction against the hour hand wheel 14. This maximum rotatability is set to be greater than the allowance for movement of the alarm setting cam 22 by way of the slope of the alarm fingers that are described later.

The characteristic features of the embodiment shown in these figures are as follows. The projections of the alarm fingers 36 and 38 are sloped. At locations nearby the engaging areas 24 and 26 of the alarm setting wheel 12, the projections 23 and 25 are provided. Furthermore, at the tops of the alarm fingers 36 and 38, recesses 35 and 37 which can be engaged with the projections 23 and 25 are provided.

Figure 5:
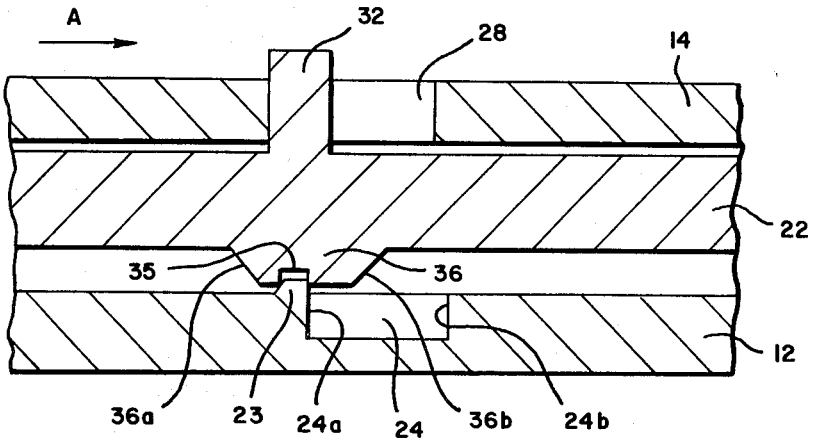
FIGS. 5, 6, 7 and 8 are diagrams for illustrating alarm setting operation of an alarm finger.
Figure 6:
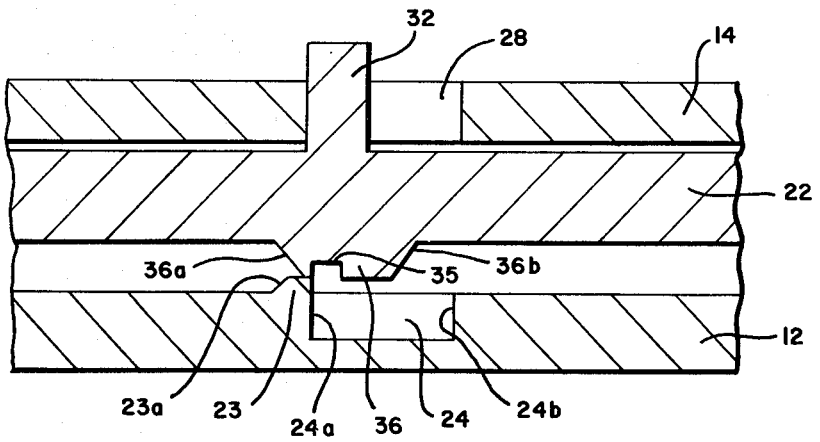

In FIG. 5, against the fixed alarm setting wheel 12, the hour hand wheel 14 rotates in the direction indicated by the arrow A, and together with it, the alarm setting cam 22 also rotates in the direction indicated by the arrow A. In the embodiments shown in the figures, a depressed surface 24*a* and a shoulder tab 24*b* of the engaging area 25 are formed to be nearly perpendicular to the alarm setting wheel surface, respectively. On the other hand, a depression 36*a* and a shoulder 36*b* of the alarm finger 36 are formed as sloping surfaces. The projection 23 is provided nearby the depression 24*a* of the engaging area 24 and it is provided with a sloping surface 23*a* in order to make it easy for the alarm finger 36 to ride onto it via the slope 23*a*. A detailed illustration of the other alarm finger 38 and the engaging area 26 is omitted here, but the relationship is the same as that between the alarm finger 36 and the engaging area 24 described above.

In the present invention, high precision in alarm setting can be achieved because of the arrangements as follows: A sloping surface 36*a* of the alarm setting cam 22 is provided which makes it possible for the alarm setting cam 22 to freely rotate in the forward direction against the hour hand wheel 14. Also, because the shoulder 36*b* of the alarm finger 36 is formed to have a sloping surface, the alarm finger 36 of the alarm setting cam 22 can easily return onto the flat surface of the alarm setting wheel 12 after the alarming operation.

As should be apparent from FIG. 1, the alarm setting cam 22 is pressed and spring loaded towards the alarm setting wheel 12 by means of a fly spring 40. The fly spring 40 is fixed to the main plate 10 at its one end by a screw 42. The other end of the spring 40 cooperates with a contact 44 fixed to the main plate 10 and forms an alarm switch. Therefore, the fly spring 40 is made of an elastic metal such as phosphor bronze. A contact portion 40*a* is provided at a part of the fly spring 40 which presses the alarm setting cam 22 towards the alarm setting wheel 12 by engaging with the shoulder 22*a* of the alarm setting cam 22. Also, as is shown by the dotted lines in FIG. 1, when the alarming operation is performed, the fly spring 40 comes into contact with the contact 44 and causes the alarm circuit to close by means of a lead wire that is not shown in the figures.

The embodiment according to the present invention is constructed as above and with reference to FIGS. 5 through 8, a description will be given of its operation. The description is omitted for the operation involving the engaging area 26 of the alarm setting wheel 12 and the alarm finger 38 of the alarm setting cam 22 which are not shown in the figures. The reason for the above is that the operation involving these members is identical with the operation of the engaging area 24 and the alarm finger 36 which are shown in the figures.

FIG. 5 shows the position slightly preceding to the alarm setting position. In this position, the recess 35 provided on the alarm finger 36 of the alarm setting cam 22 engages with the projection 23 provided on the alarm setting wheel 12 and through this engagement they maintain their positions shown in the figure against the spring force of the fly spring 40 shown in FIG. 1. When the hour hand wheel 14 and the alarm setting cam 22 move in the direction indicated by the arrow A from the state described above and reach the position of the alarm triggering time shown in FIG. 6, the sloping surface 36*a* of the alarm finger 36 meets the depression 24*a* of the engaging area 24. Upon this meeting, the alarm setting cam 22 proceeds to the position shown in FIG. 7 because the alarm setting cam 22 itself is spring loaded by the fly spring 40. As a result, the fly spring 40 in FIG. 1 comes in contact with the contact 44.

Figure 8:
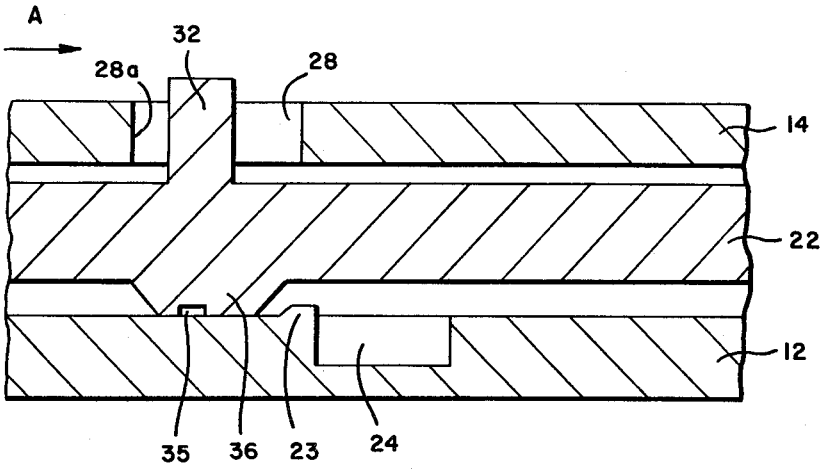

In the usual situation, the alarm setting cam 22 rotates together with the rotation of the hour hand wheel 14 while maintaining the state wherein its protrusion is in contact with a wall surface 28*a* of the loose joint 28. At the same time, the alarm finger 36 of the alarm setting cam 22 approaches the engaging area 24 of the alarm setting wheel 12. However, when the frictional force between the hour hand wheel 14 and the alarm setting cam 22 is greater than the frictional force between the alarm setting wheel 12 and the alarm setting cam 22, the rotation continues with the protrusion 32 of the alarm setting cam 22 not in contact with the wall surface 28*a* of the loose joint 28 of the hour hand wheel 14, as shown in FIG. 8. The alarm time is set to be that when the alarm finger 36 drops into the engaging area 24 while the protrusion 32 is in contact with the wall surface 28*a* of the loose joint 28. Therefore, if the alarm finger 36 drops into the engaging area 24 when the protrusion 32 is not in contact with the wall surface 28*a* of the loose joint 28, the result is that the actual alarm time deviates from the time set for alarming.

In this embodiment shown here, even when the alarm setting cam rotates with the protrusion 32 not in contact with the wall surface 28*a* of the loose joint 28, accurate alarm setting can be performed. The reason for this is described below. If the alarm setting cam 22 further continues rotation from the state shown in FIG. 8, the recess 35 provided on the alarm finger 36 engages with the projection 23, as shown in FIG. 5. At this time, the fit-joining force between the alarm setting wheel 12 and the alarm setting cam 22 becomes greater than the frictional force between the hour hand wheel 14 and the alarm setting cam 22. As a result, while the alarm setting cam 22 remains stationary, the hour hand wheel 14 rotates until the protrusion 32 comes into the contact with the wall surface 28*a* of the loose joint 28. Thereafter, if the hour hand wheel 14 continues to rotate, protrusion 32 of the alarm setting cam 22 is pressed by the wall surface 28*a* of the loose cam 28 of the hour hand wheel 14 to cause the alarm setting cam 22 to rotate together with the hour hand wheel 14. Accordingly, the dropping of the alarm setting cam 22 is performed reliably and also a high precision in alarm setting can be obtained.

The degree of inclination of the sloping surface 36*a* of the alarm finger 36 can be readily determined by considering the frictional force between the alarm setting cam 22 and the alarm setting wheel 12.

Figure 7:
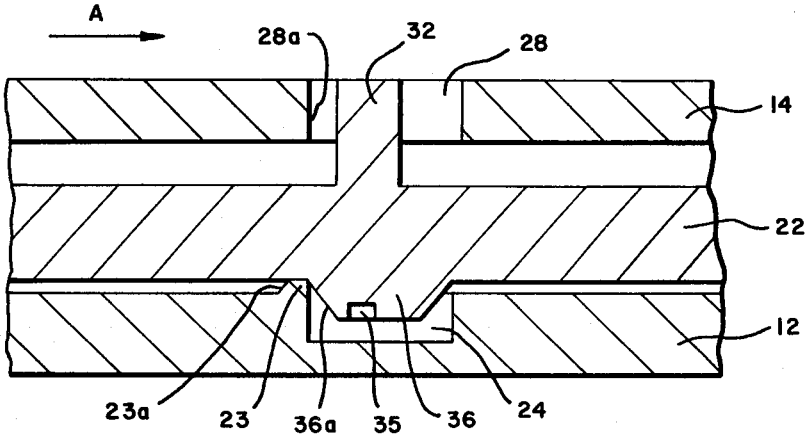

In FIG. 7, when the hour hand wheel 14 is rotated in a direction opposite to the direction indicated by the arrow A for the purpose of adjusting the time, etc. or when the alarm setting wheel 12 is rotated in the direction indicated by the arrow A in order to adjust the time, the alarm finger 36 can move up from the engaging area 24 in a manner that the sloping surface 36*a* of the alarm finger 36 runs up and over the depression 24*a* of the projection 23.

In this embodiment, the depth of the recess 35 is made relatively shallow so that the engagement between the recess 35 and the projection 23 can be easily broken by the manual operation that is performed at a relatively high speed and large rotating force when reversely rotating the hour hand wheel 14. As described above, in this embodiment, when adjusting the alarm setting time or the actual time, the shaft for such adjustment can be rotated in both forward and backward directions. Also, the alarming operation can be triggered exactly at the time set for giving the alarm.

Figure 9:
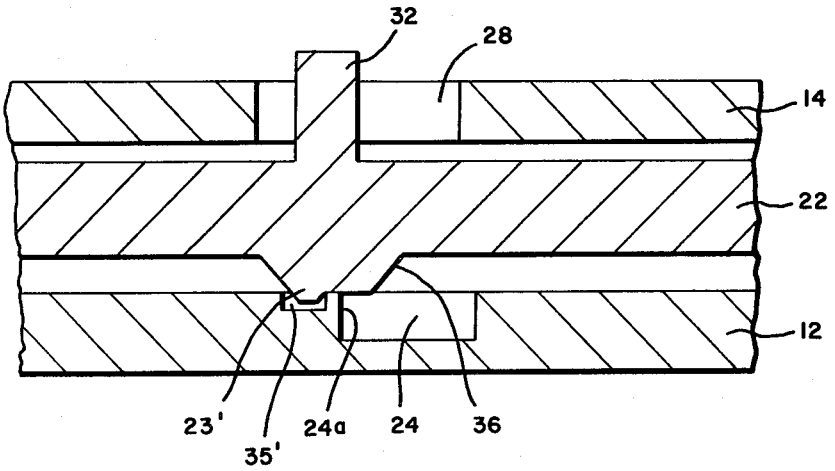
FIG. 9 is a sectional view showing another modification of a projection and a recess of the first embodiment.

FIG. 9 shows another embodiment in accordance with the teachings of the present invention. The characteristics and features of this embodiment are that a projection 23' is formed at the top of the alarm finger 36 and that nearby the engaging area 24 of the alarm setting wheel 12, a recess 35' which can engage with the projection 23' is provided. Since the operation and the effect of this embodiment is similar to that of the embodiments described above, a detailed description of this embodiment is omitted.

Figure 10:
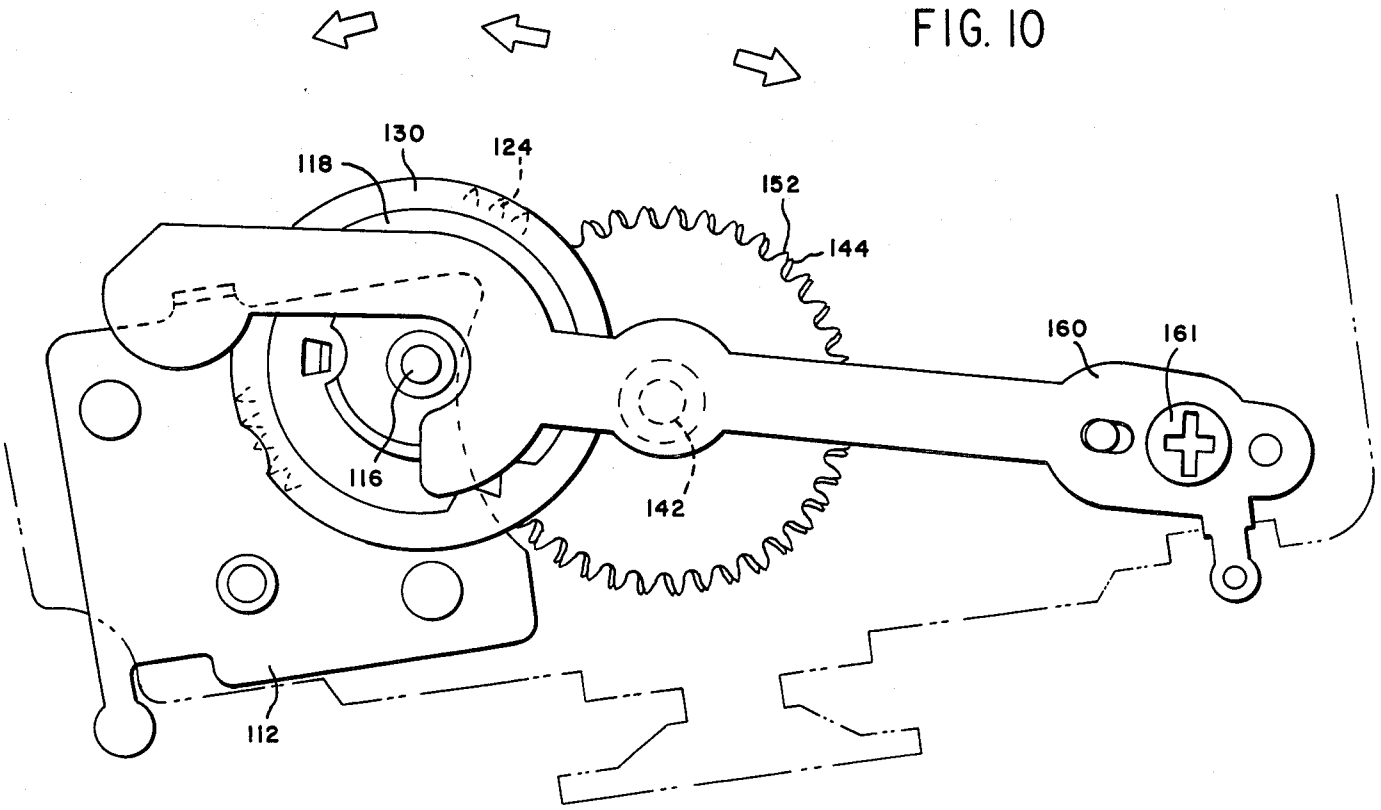
FIG. 10 is the plan view illustrating a second preferred embodiment of an alarm setting device in accordance with the teachings of the present invention.
Figure 11:
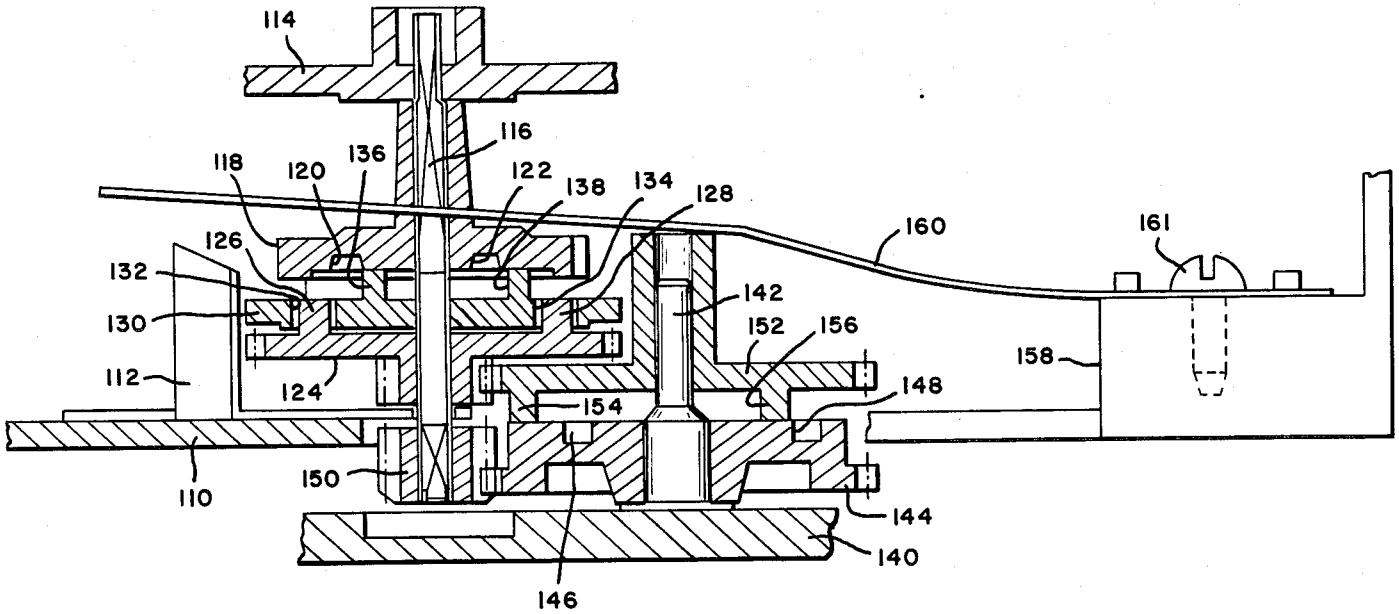
FIGS. 11, 12 and 13 are sectional side elevational views showing the alarm setting operation of the alarm setting device shown in FIG. 10.
Figure 12:
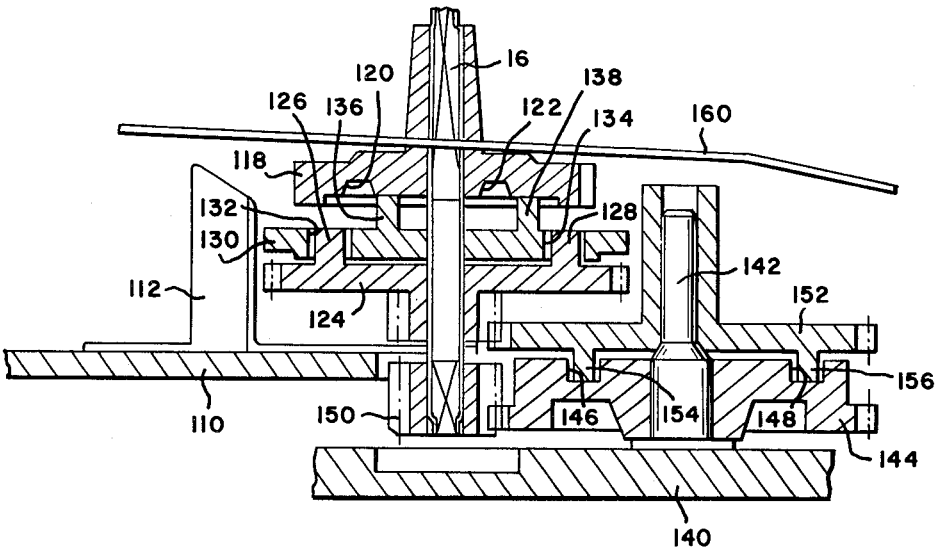
Figure 13:
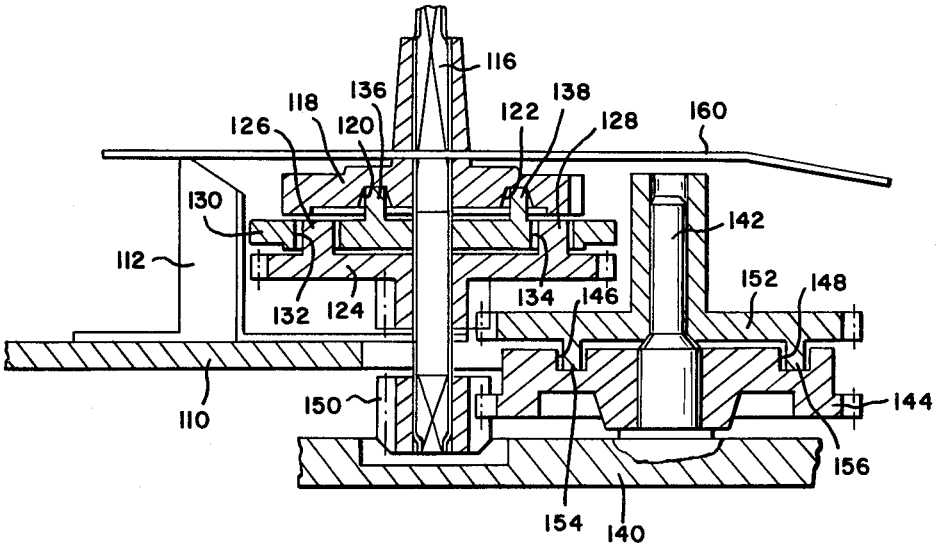

Referring to FIG. 10, shown therein is a second preferred embodiment of an alarm setting device in accordance with the teachings of the present invention. FIGS. 11 through 13 show sectional side elevational views of the essential portions of FIG. 10. In FIG. 11, by a fixed contact plate 112 that is fixed to the main plate 110 of the timepiece as well as by a dust cover 114, a shaft 116 for adjusting an alarm setting wheel is axially and freely rotatably supported. To one end of the axle 116 for adjusting the alarm setting wheel, a knob for adjusting the alarm setting wheel (not shown in the figures) is fixed.

The first alarm setting cam mechanism includes a shaft 116 for adjusting the alarm setting wheel, a first alarm setting wheel 118 that is the alarm setting wheel of the present invention, an alarm setting cam 130 and a first alarm intermediate wheel 124 that forms an alarm intermediate wheel of the present invention. The second alarm setting cam mechanism includes a second alarm setting wheel 144 and a second alarm intermediate wheel 152.

Firstly, a description will be given of the first alarm setting cam mechanism. To the axle 116 for adjusting the alarm setting wheel, the first alarm setting wheel 118 is fixed. On the gear face of the first alarm setting wheel 118, two engaging portions 120 and 122 are provided at mutually opposite radial positions. Also, the first alarm intermediate wheel 124 is axially and freely rotatably supported by the axle 116 for adjusting the alarm setting wheel. On the gear surface of the first alarm intermediate wheel 124, two projections 126 and 128 are formed integrally with the intermediate wheel 124. The first alarm intermediate wheel 124 engages with a day wheel (not shown in the figures) and rotates once every three hours, just as the minute wheel.

In addition, between the first alarm setting wheel 118 and the first alarm intermediate wheel 124, the alarm setting cam 130 is axially supported to rotate and slide freely on the axle 116 for adjusting the alarm setting wheel. In the gear face of the alarm setting wheel 130 that faces towards the first alarm intermediate wheel 124, two loose joints 132 and 134 are formed. These loose joints 132 and 134 serve to loosely join with the projections 126 and 128 of the first alarm intermediate wheel 124 and also make it possible for the alarm setting cam 130 to rotate in mutually reciprocal directions for a predetermined amount along the circumferential direction against the first alarm intermediate wheel 124. In this embodiment, the loose joints 132 and 134 are formed as throughholes. Also, on the gear wheel surface of the alarm setting cam 130 that faces to the first alarm setting wheel 118, two alarm fingers 136 and 138 which are to engage the engaging portions 120 and 122 of the first alarm setting wheel 118 are formed integrally with the alarm setting cam 130. Through the engagement between the engagement portions 120 and 122 and the alarm fingers 136 and 138 desired alarming operations are performed.

The description now will be given of the second alarm setting cam mechanism.

The second alarm setting wheel 144 is freely rotatably supported on axle 142 which is fixed to the backing plate of the device 140. On the gear face of the second alarm setting wheel 144, two engagement portions 146 and 148 are formed at mutually different radial positions. The second alarm setting wheel 144 engages with an adjusting pinion 150 that is fixed to one end of the axle 116 for adjusting the alarm setting wheel. Therefore, by rotating the knob for adjusting the alarm setting wheel, together with the first alarm setting wheel 118, the second alarm setting wheel 144 is set at a desired alarm time position. Also, a second alarm intermediate wheel 152 is freely rotatably supported by the axle 142. The second alarm intermediate wheel 152 engages with the first alarm intermediate wheel 124 and rotates at a ratio of once every twelve hours. Furthermore, on the gear face of the second alarm intermediate wheel 152, alarm fingers 154 and 156 which engage with the engaging portions 146 and 148 of the second alarm setting wheel 144 are formed integrally with the second alarm intermediate wheel 152.

In addition, to a seat 158 that is fixed to the main plate 110, one end of a movable contact plate 160 is fixed by means of a screw 161. This movable contact plate 160 is made of an elastic metal such as phosphor bronze. The movable contact plate 160 presses the first alarm setting wheel 118 and the second alarm intermediate wheel 152 towards the alarm setting cam 130 and the second alarm setting wheel 144, respectively. With such a construction, the movable contact plate 160 comes into contact with the fixed contact plate 112 and the alarming circuit that is connected to the contact plates 112 and 160 is actuated. That is, the engaging portions 146 and 148 of the second alarm setting wheel 144 engage with the alarm fingers 154 and 156 of the second alarm intermediate wheel 152 while the engaging portions 120 and 122 of the first alarm setting wheel 118 engage with the alarm fingers 136 and 138 of the alarm setting cam 130.

Figure 15:
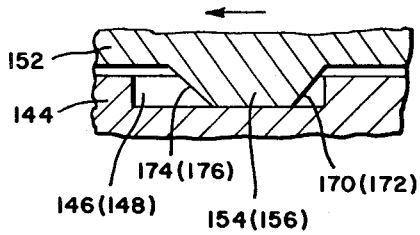
FIG. 15 is a sectional view of the essential portions showing the engagement between an engaging portion of the second setting wheel and an alarm finger of the second immediate wheel of the alarm setting device shown in FIG. 10.
Figure 14:
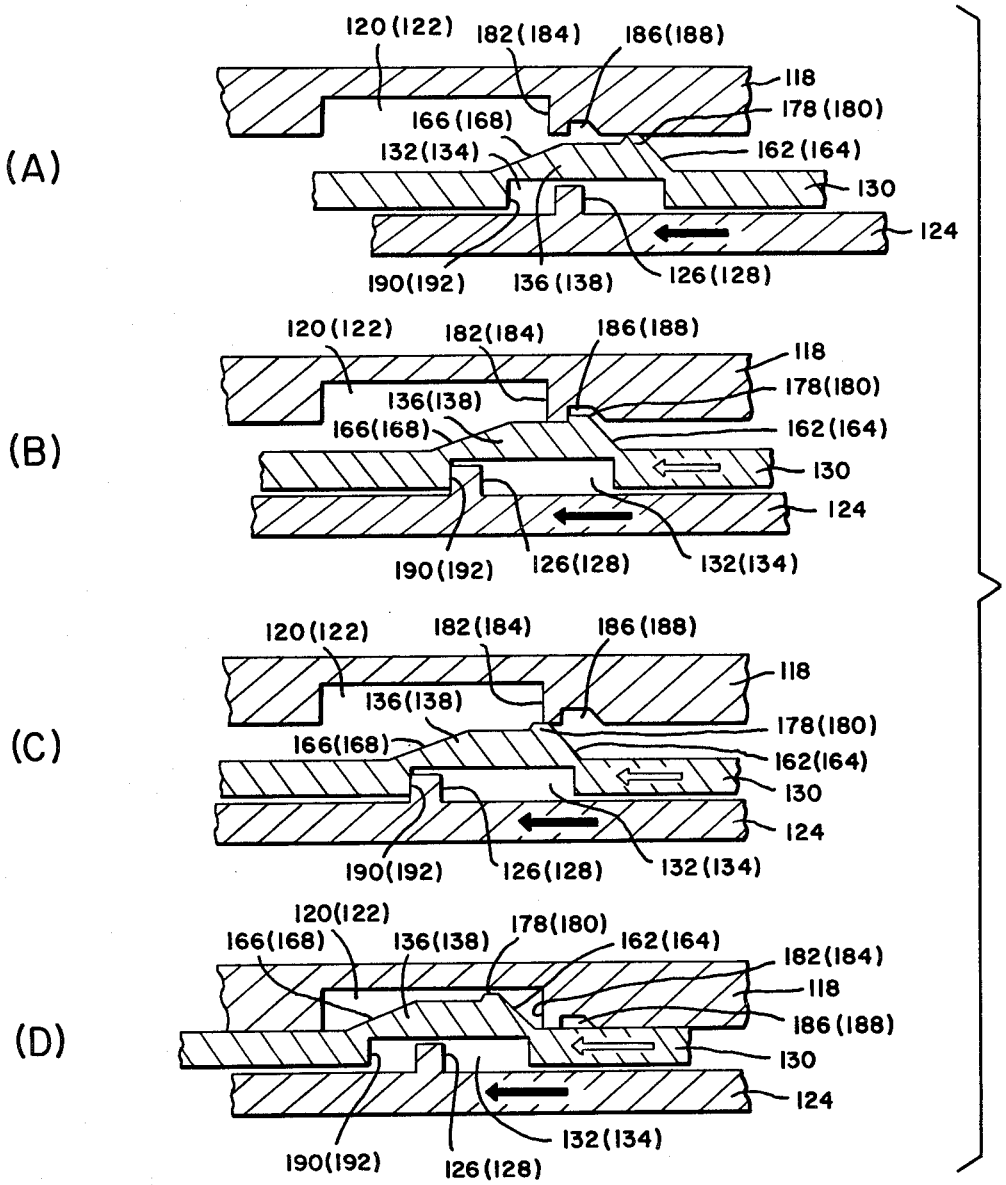
FIGS. 14A–D is a sectional view of the essential portions showing the alarm setting operation of the alarm setting device shown in FIG. 10 in detail.

The characteristic features of this embodiment are as follows. The sloped depression and the sloped shoulder are provided either for the engaging portion of the first alarm setting wheel or for the alarm finger of the alarm setting cam and also either for the engaging portion of the second alarm setting wheel or for the alarm finger of the second alarm intermediate wheel. In addition, at either one of the locations adjacent the depressions of the engaging portion of the first alarm setting wheel or adjacent the depressions of the top of the alarm finger of the alarm setting cam, a projection is provided, while at the other one of the locations, the recess that can be engaged with the projection is provided. In other words, in this embodiment, as shown in FIG. 14, the alarm finger 136 (138) of the alarm setting cam 130 is provided with a sloped depression 162 (164) and a sloped shoulder 166 (168). Also, as shown in FIG. 15, the alarm finger 154 (156) of the second alarm intermediate wheel 152 is provided with a sloped depression 170 (172) and a sloped shoulder 174 (176). Consequently, during the adjustment of the alarm time, the alarm finger 136 (138) and 154 (156) are depressed or shouldered by means of the depression 162 (164) and 170 (172) and the shoulders 166 (168) and 174 (176). Therefore, not only by the forward rotation of the axle for adjusting the alarm setting wheel but also by the backward rotation thereof, the time set for alarming can be adjusted.

Furthermore, as shown in FIG. 14, at a location adjacent the depressions 162 (164) on the top of the alarm finger 136 (138) of the alarm setting cam 130, a projection 178 (180) is a single unit with the alarm finger 136 (138). On the other hand, at a point adjacent the depression 182 (184) of the engaging portion 120 (122) of the first alarm setting wheel 118, recess 186 (188) that can engage with the projection 178 (180) is formed.

By means of the engagement of the projection 178 (180) with the recess 186 (188), the protrusion 126 (128) of the first alarm intermediate wheel 124 is pressed against the wall surface 190 (192) of the loose joint 132 (134) of the alarm setting cam 130. As a result, high precision in alarm setting can be obtained.

The second embodiment according to the present invention is constructed as described above and hereunder will be given a description of its operation. First, the description will start with the operation for setting the alarming time.

As should be clear from FIG. 11, when the knob for adjusting the alarm setting wheel is rotated, the first alarm setting wheel 118 that is fixed to the axle 116 for adjusting the alarm setting wheel is rotated. Also, through the adjusting pinion 150, the alarm setting wheel 144 is rotated. Accordingly, the first alarm setting wheel 118 and the second alarm setting wheel 144 rotate for a predetermined extent against the alarm setting cam 130 and the second alarm intermediate wheel 152, respectively, and they are positioned at rotated positions corresponding to the desired time for alarming. At this time, the first alarm setting wheel 118 and the second alarm setting wheel 144 are clicked by the click lever that is omitted from the figures. In this way, the desired alarm setting position can be obtained. Then, the adjusting of the set alarming time can be done by the forward or backward rotation of the axle 116 for adjusting the alarm setting wheel.

As shown in FIG. 14, the alarm fingers 136 and 138 of the alarm setting cam 130 are provided with sloped depressions 162 and 164 and sloped shoulders 166 and 168. Similarly, as shown in FIG. 15, the alarm fingers 154 and 156 of the second alarm intermediate wheel 152 are provided with sloped depressions 170 and 172 and sloped shoulders 174 and 176, respectively. Consequently, the alarm fingers 136 and 138 and 154 and 156 which are respectively depressed into the engaging portions 120 and 122 and 146 and 148 are able to return towards the gear wheel surfaces via the depressions 162, 164, 170, 172 or the shoulders 166, 168, 174 and 176. Hence, the alarm setting time can be adjusted by the forward or backward rotation of the axle 116 for adjusting the alarm setting wheel.

Also for adjusting the actual time, by the same operation described above, the alarm setting cam 130 and the second alarm intermediate wheel 152 can be optionally rotated against the first alarm setting wheel 118 and the second alarm setting wheel 144, respectively, through the operation of the time adjusting knob (not shown in the figures). Therefore, by the reciprocal rotation of the time adjusting knob, the time can also be adjusted.

As shown in FIG. 11, when a wheel train of the timepiece continues to be driven when it is set at a desired time for alarming, the first alarm intermediate wheel 124 that is engaged with the minute wheel rotates at a ratio of once every three hours while the second alarm intermediate wheel 152 that engages with the first alarm intermediate wheel 124 rotates once every twelve hours. Then, when the time reaches the point several minutes before the time set for alarming, as shown in FIG. 15 the alarm fingers 154 and 156 of the second alarm intermediate wheel 152 fall into the engaging portions 146 and 148 of the second alarm setting wheel 144. At this time, as shown in FIG. 12, the movable contact plate 160 releases the spring load onto the second alarm intermediate wheel 152 and keeps the spring load or bias only onto the first alarm setting wheel 118. In an ordinary situation, the alarm setting cam 130 rotates together with the rotation of the first alarm intermediate wheel 124 with the protrusions 126 and 128 in contact with the wall surfaces 190 and 192 of the loose joints 132 and 134. At the same time, the alarm fingers 136 and 138 formed on the alarm setting cam 130 approach the engaging portions 120 and 122 of the first alarm setting wheel 118. However, when the frictional force between the first alarm intermediate wheel 124 and the alarm setting cam 130 is greater than the frictional force between the first alarm setting wheel 118 and the alarm setting cam 130, as shown in FIG. 14 (A), the rotation continues in the state with the protrusions 126 and 128 of the first alarm intermediate wheel 124 are not in contact with the wall surfaces 190 and 192 of the loose joints 132 and 134 of the alarm setting cam 130. The alarm setting time is set to occur when the alarm fingers 136 and 138 fall into the engaging portions 120 and 122 and when the protrusions 126 and 128 are in contact with the wall surfaces 190 and 192 of the loose joints 132 and 134. Consequently, if the alarm fingers 136 and 138 fall into the engaging portions 120 and 122 when the protrusions 126 and 128 are not in contact with the wall surfaces 190 and 192 of the loose joints 132 and 134, the actual alarming time deviates from the time set for actuating the alarm. In this second embodiment, as described above, even when the alarm setting cam 130 rotates when the protrusions 126 and 128 are not in contact with the wall surfaces 190 and 192 of the loose joints 132 and 134, accurate alarm triggering could be performed.

When the alarm setting cam 130 continues to further rotate from the state shown in FIG. 14 (A), the projections 178 and 180 provided on the alarm fingers 136 and 138 engage with the recesses 186 and 188 as shown in FIG. 14 (B). At this time, the fit-jointing force between the first alarm setting wheel 118 and the alarm setting cam 130 becomes greater than the frictional force between the first alarm intermediate wheel 124 and the alarm setting cam 130. As a result, the first alarm intermediate wheel 124 rotates until the projections 126 and 128 come into contact with the wall surfaces 190 and 192 of the loose joints 132 and 134 and the alarm setting cam 130 remains stationary. Thereafter, if the first alarm intermediate wheel 124 further continues to rotate, the alarm setting cam 130 rotates pressed by the protrusions 126 and 128 of the first alarm intermediate wheel 124 and the projections 178 and 180 of the alarm fingers 136 and 138 ride up from the recesses 186 and 188 of the first alarm setting wheel 118 through the sloping surfaces formed in these projections 178 and 180. Then, when the time set for alarming that is indicated by the chained line is reached, as shown in FIG. 14 (C), the ends of the projections 178 and 180 are located at the ends of the depressing surfaces 182 and 184 of the engaging portions 120 and 122 of the first alarm setting wheel 118. From this state, the alarm fingers 136 and 138 of the alarm setting cam 130 fall into the engaging portions 120 and 122 of the first alarm setting wheel 118 by means of the depressing surfaces 162 and 164, as shown in FIG. 14 (D). At this time, as shown in FIG. 13, the movable contact plate 160 comes into contact with the fixed contact plate 112. By this contact, the alarm operation circuits including the alarm circuit and the timer circuit which are connected to these contact plates 112 and 160 are actuated.

Thereafter, if the first alarm intermediate wheel 124 continues to rotate, the alarm setting cam 130 rotates depressed by the protrusions 126 and 128 of the first alarm intermediate wheel 124 and the alarm fingers 136 and 138 return towards the gear wheel surfaces from the engaging portions 120 and 122 of the first alarm setting wheel 118 by way of the shoulders 166 and 168. At this time, the first alarm setting wheel 118 presses the movable contact plate 160 against the spring force of the movable contact plate 160. Consequently, both contact plates 112 and 160 are released from contacting and the alarming operation is completed.

As described above, in the second embodiment and as shown in FIG. 14 (B), immediately before the alarming time occurs, by means of the engagement between the projections 178 and 180 and recesses 186 and 188, the protrusions 126 and 128 of the first alarm intermediate wheel 124 are pressed into contact with the wall surfaces 190 and 192 of the loose joints 132 and 134 of the alarm setting cam 130. Therefore, as is shown in FIG. 14 (C), the alarm operation is performed with high precision.

In addition, the contact between the contact plates 112 and 160 is performed by means of the depressing operation of the alarm setting cam 130 that rotates once every three hours. As a result, in comparison with the use of a twelve hour wheel as in the conventional practice, higher precision in alarm setting can be obtained. Also in the embodiment described above, the projections 178 and 180 are provided at locations adjacent the depressions 162 and 164 at the tops of the alarm fingers 136 and 138 of the alarm setting cam 130. On the other hand, the recesses 186 and 188 which can engage with the projections 178 and 180 are provided at locations adjacent the depressions 182 and 184 of the engaging portions 120 and 122 of the first alarm setting wheel 118. However, it may be designed as follows. That is, the projections could be provided at locations adjacent the depressions 182 and 184. Then, through the engagements between the projections 178 and 180 and the alarm fingers 136 and 138 of the alarm setting cam 130, the protrusions 126 and 128 of the first alarm intermediate wheel 124 are pressed into contact with the wall surfaces 190 and 192 of the loose joints 132 and 134 of the alarm setting cam 130. In this case, the spring force of the movable contact plate 160 must be set to bring about the following condition. That is, the frictional force between the first alarm setting wheel 118 and the alarm setting cam 130 which depends on the engagement between the alarm fingers 136 and 138 with the projections must be greater than the frictional force between the first alarm intermediate wheel 124 and the alarm setting cam 130.

Furthermore, it may be constructed as follows. That is, the engaging portions 120 and 122 and the recesses 186 and 188 of the first alarm setting wheel 118 could be formed on the alarm setting cam 130; while the alarm fingers 136 and 138 of the alarm setting cam 130 could be formed on the first alarm setting wheel 118. In addition, it is also an acceptable construction which is within the teachings of the present invention that the loose joints 132 and 134 of the alarm setting cam 130 could be formed in the first alarm intermediate wheel 124 with the protrusions 126 and 128 of the first alarm intermediate wheel 124 formed in the alarm setting cam 130.

In this embodiment, the foregoing recess 186 can be formed relatively shallow so that the engagement between the recess 186 and the projection 178 can be released easily by the manual rotational force which occurs at a relatively high speed and with a high amount of force during the reverse rotation of the first alarm intermediate wheel 124.

Figure 16:
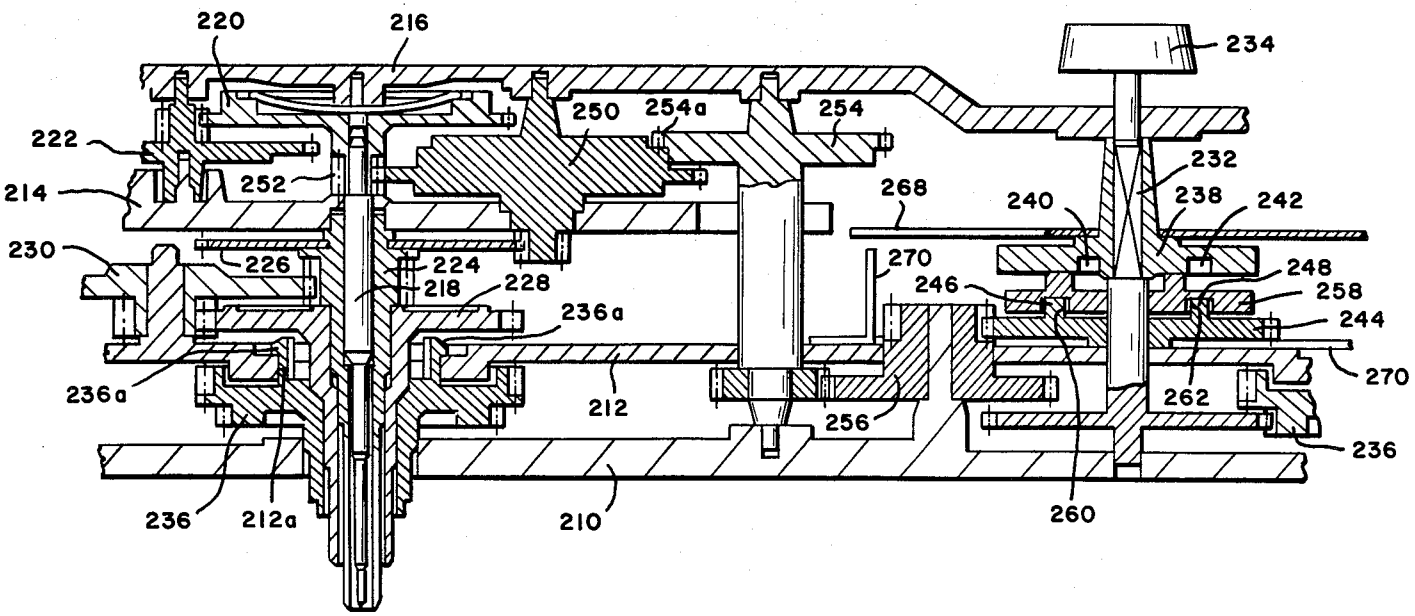
FIG. 16 is a sectional side elevational view showing a third preferred embodiment of an alarm setting device in accordance with the teachings of the present invention.

Referring to FIG. 16, shown therein is the third embodiment of an alarm setting device in accordance with the teachings of the present invention. In conjunction with this figure, firstly, a description will be given of the wheel train of the timepiece. An axle 218 is supported axially by main plates 210, 212 and 214 and a case 216 in a freely rotatable manner. To the axle 218, a second hand wheel 220 is fixed. The second hand wheel 220 engages with the fifth wheel 222 that is held freely rotatably and axially by the main plate 214 and a case 216. Also, in the outer circumference of the axle 218, a minute hand wheel 224 is held axially and freely rotatable. To the minute hand wheel 224, a minute hand gear 226 is frictionally connected. In addition, in the outer circumference of the minute hand wheel 224, hour hand wheel 228 is held axially and freely rotatable. These minute hand wheel 224 and hour hand wheel 228 engage with a day wheel 230 that is held axially by the main plate 212 and freely rotatable.

Next, a description will be given of the alarm setting cam mechanism. An alarm setting axle 232 is coupled freely rotatably and axially by the main plates 210 and 212 and the case 216. The alarm setting axle 232 is the axle for adjusting the alarm setting wheel. To one end of the alarm setting axle 232, an alarm setting knob 234 is fixed. Also, to the main plate 212, an alarm setting wheel 236 is freely rotatably coupled. The alarm setting wheel 236 is constructed to rotate by interlocking with the alarm setting axle 232. As is generally known, the alarm setting wheel 236 has an elastic, split type ring **236*a* that is formed integrally with the plastic body of the alarm setting wheel 236. This elastic, split type ring 236*a* is fitted and connected to an open hole 212*a* provided in the main plate 212**.

To the alarm setting axle 232, an alarm setting wheel 238 is fixed. On the gear face of this alarm setting wheel 238, two engaging portions 240 and 242 are formed at mutually different positions in the direction of the diameter. Also, by the alarm setting axle 232, an alarm intermediate wheel 244 is axially and freely rotatably coupled. This intermediate wheel 244 is provided on its gear face with two protrusions 246 and 248 which are combined with the alarm intermediate wheel 244 to form a single unit.

The alarm intermediate wheel 244 is constructed to rotate once every twelve hours by interlocking with the wheel train of the timepiece. In other words, by the main plate 214 and the case 216, a ten minute wheel 250 is held axially and freely rotatably. This ten minute wheel engages with a second hand pinion 252 formed in the second hand wheel 220, as well as with the minute hand gear 226. Also, by the main plates 210 and 212 and the case 216, a two hour wheel 254 that engages with the ten minute wheel 250 is held axially and freely rotatably. This two hour wheel 254 engages with a four hour wheel 256 that is held axially and freely rotatably by the main plates 210 and 212. Furthermore, the four hour wheel 256 engages with the alarm intermediate wheel 244.

Figure 17:
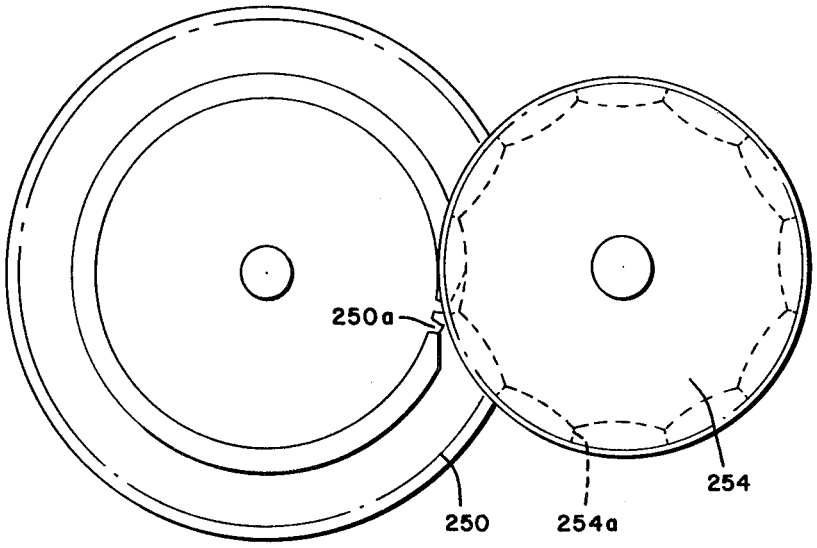
FIG. 17 is a plan view illustrating a ten minute wheel and a two hour wheel shown in FIG. 16.

FIG. 17 shows a plan view of the ten minute wheel 250 and the two hour wheel 254. As should be evident from FIG. 17, the ten minute wheel 250 is provided with two intermittent feed teeth **250*a*, and the two hour wheel 254 is provided with twelve engaging points 254*a* which are to engage with the intermittent feed teeth 250*a*. The engaging points 254*a* of the two hour wheel 254 are engaged with the intermittent feed teeth 250*a* of the ten minute wheel 250 such that the engaging point 254*a* is caught between the two intermittent feed teeth 250*a*. Accordingly, the two hour wheel 254 rotates intermittently for only 30 degrees while the ten minute wheel 250** completes one rotation.

As described above, one of the characteristic features of this embodiment is that the alarm intermediate wheel 244 is driven intermittently by engaging with the wheel train of timepiece. As a result, a high precision in alarm setting can be obtained.

In addition, between the alarm setting wheel 238 and the alarm intermediate wheel 244, an alarm setting cam 258 is held axially, freely rotatably and freely slidably against the alarm setting axle 232. On the gear face of the alarm setting cam 258 that faces towards the alarm intermediate wheel 244, two loose joints 260 and 262 are provided. These loose joints 260 and 262 are to loosely engage with the protrusions 246 and 248 of the alarm intermediate wheel 244 and to make it possible for the alarm setting cam 258 to rotate for a predetermined extent in the circumferential direction reciprocally against the alarm intermediate wheel 244. In this embodiment, the loose joints 260 and 262 are provided in the form of loose joint grooves. Also, on the gear surface of the alarm setting cam 258 that faces to the alarm setting wheel 238, two alarm fingers 264 and 266 which are to engage with the engaging portions 240 and 242 of the alarm setting wheel 238 are formed integrally with the alarm setting cam 258. Through the engagement between these engaging portions 240 and 242 with the alarm fingers 264 and 266, a desired alarm setting operation as will be described below can be performed.

Furthermore, to the main plate 212, one end of a movable contact plate 268 that is made of an elastic metal plate such as phosphor bronze is fixed. The other end of this movable contact plate 268 spring biases the alarm setting wheel 238 towards the alarm setting cam 258. Also, to the main plate 212, a fixed contact plate 270 that is able to come into contact with, as well as to be disengaged from the movable contact plate 268, is fixed. With this construction, when the engaging portions 240 and 242 of the alarm setting wheel 238 engage with the alarm fingers 264 and 266 of the alarm setting cam 258, the movable contact plate 268 contacts the fixed contact plate 270 and the alarming operation circuit connected to these contact plates 268 and 270 is actuated.

Characteristic points in this embodiment are as follows. That is, a sloped depression and a sloped shoulder are provided either in the engaging portion of the alarm setting wheel or in the alarm finger of the alarm setting cam. Also, at either one of the locations adjacent the depression of the engaging portion or adjacent the depression at the top of the alarm finger, a projection is formed; while at the other one of the locations, a recess that can engage with the projection is formed.

Figure 18:
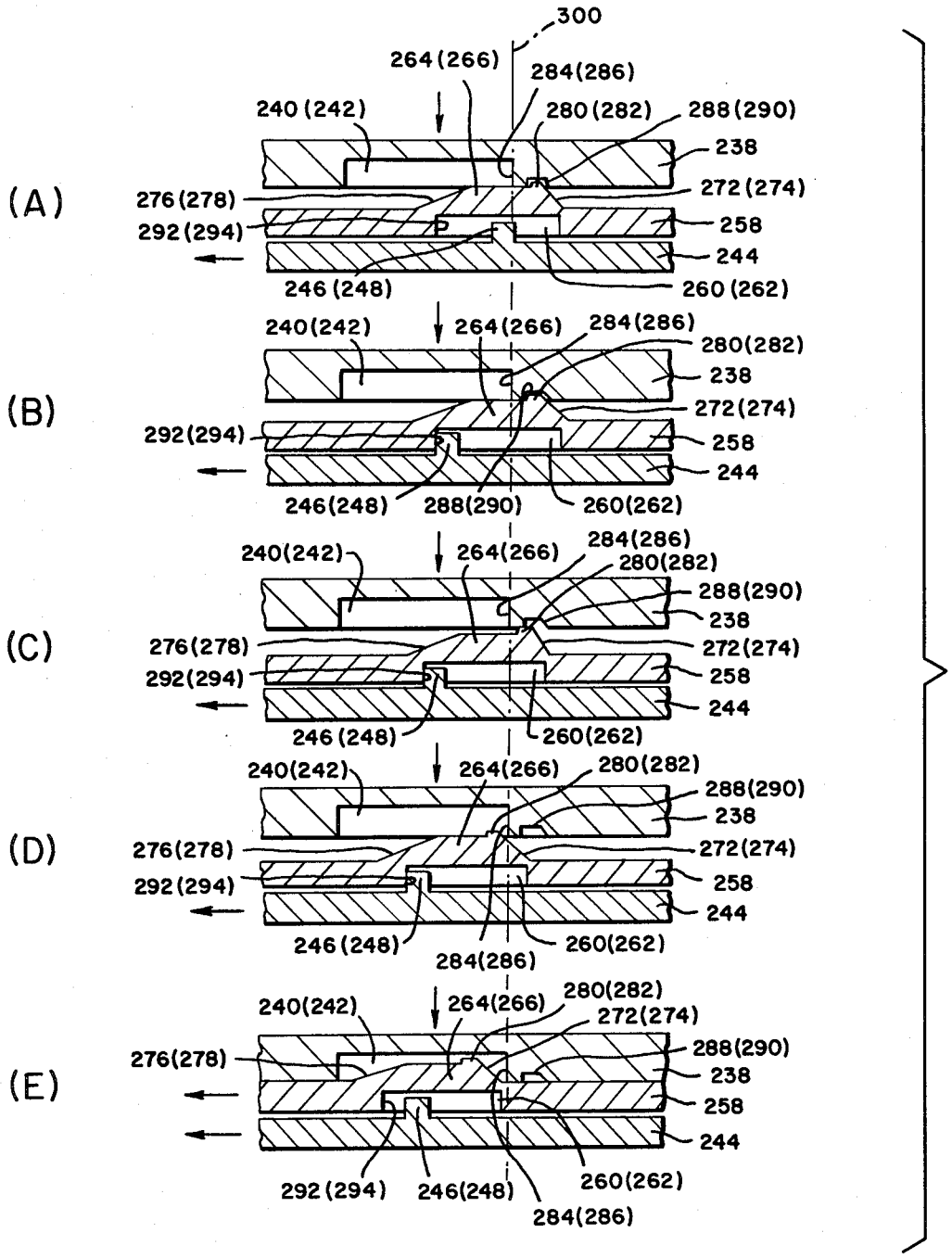
FIGS. 18A–E is a sectional view of the essential portions showing the setting operation of the alarm setting device shown in FIG. 16 in detail.

Therefore, in this embodiment, the alarm finger 264 (266) of the alarm setting cam 258 is provided with a sloped depression 272 (274) and a sloped shoulder 276 (278) as shown in FIG. 18. Accordingly, during the adjustment of the alarm setting time, these alarm fingers 264 and 266 are depressed or shouldered by way of the depressions 272 and 274 and the shoulders 276 and 278. Consequently, not only when the alarm setting axle 232 is rotated clockwise, but also, when it is rotated counterclockwise, the alarm setting time can be adjusted.

Also, as shown in FIG. 18, at a location adjacent to the depression 272 (274) on the top of the alarm finger 264 (266) of the alarm setting cam 258, a projection 280 (282) is provided integrally with the alarm finger 264 (266). On the other hand, at a location adjacent to a depression 284 (286) of the engaging portion 240 (242) of the alarm setting wheel 238, a recess 288 (290) that can engage with the projection 280 (282) is formed. Through the engagement between the projection 280 (282) with the recess 288 (290), the protrusion 246 (248) of the alarm intermediate wheel 244 is pressed into a wall surface 292 (294) of the loose joint 260 (262) of the alarm setting cam 258. As a result, a high precision in alarm setting operation can be obtained.

The third embodiment according to the present invention has the construction as described above. Hereunder, the description will be given on its operation. Firstly, a description starting with the operation for setting the alarm time will be given.

As should be clearly seen in FIG. 16, when the alarm setting knob 234 is rotated, the alarm setting wheel 238 that is fixed to the alarm setting axle 232 is rotated. Also, by interlocking with the alarm setting axle 232, the alarm setting wheel 236 is rotated. As a result, the alarm setting wheel 238 rotates for a predetermined amount against the alarm setting cam 258 and is positioned at a rotational position corresponding to the desired alarm setting time. At this time, the alarm setting wheel 238 is clicked by the click lever (not shown in the figures) and thus high alarm setting precision can be obtained.

Thereafter, the adjustment of the set alarming time can be done by rotating the alarm setting axle 232 in a clockwise or a counterclockwise direction. In other words, as shown in FIG. 18, the alarm finger 264 (266) of the alarm setting cam 258 is provided with the depression 272 (274) and the shoulder 276 (278). Consequently, the alarm finger 264 (266) that fell into the engaging portion 240 (242) can return to the gear surface via the depression 272 (274) or the shoulder 276 (278). Accordingly, the alarm setting time can be adjusted by the rotation of the alarm setting axle 232 in a clockwise or a counterclockwise direction. Also, for the time adjustment, the same operation as described above can be used. That is, the alarm setting cam 258 can be rotated optionally against the alarm setting wheel 238 and therefore, the time can be adjusted through rotating the alarm setting knob 234 clockwise or counterclockwise.

As is shown in FIG. 16, when the wheel train of timepiece continues to be driven with the alarm setting at the desired alarming time, the ten minute wheel 250 that is engaged with the minute hand gear 226 and the second hand pinion 252 rotates at a ratio once every ten minutes. Consequently, the two hour wheel 254 rotates intermittently at the rate of 30 degrees per ten minutes by means of the engagement between the engaging points **254*a* provided in the two hour wheel 254 and the intermittent feed teeth 250*a* provided in the ten minute wheel 250. Hence, the rotation of the two hour wheel 254 is transmitted through the four hour wheel 256 to the alarm intermediate wheel 244, and the alarm intermediate wheel 244** continues rotation at a rate of once every twelve hours while rotating intermittently.

The alarm setting cam 258 rotates together with the intermittent rotation of the alarm intermediate wheel 244, with the loose joint 260 (262) being kept in contact with the protrusion 246 (248). At the same time, the alarm finger 264 (266) formed in the alarm setting cam 258 approaches the engaging portion 240 (242) of the alarm setting wheel 238. However, when the frictional force between the alarm intermediate wheel 244 and the alarm setting cam 258 is greater than the frictional force between the alarm setting wheel 238 and the alarm setting cam 258, the rotation continues with the protrusion 246 (248) of the alarm intermediate wheel 244 not in contact with the wall surface 292 (294) of the loose joint 260 (262) of the alarm setting cam 258. The time for triggering the alarm operation is set to occur when the alarm finger 264 (266) falls into the engaging portion 240 (242) while the protrusion 246 (248) is in contact with the wall surface 292 (294) of the loose joint 260 (262). Consequently, if the alarm finger 264 (266) falls into the engaging portion 240 (242) while the protrusion 246 (248) is not in contact with the wall surface 292 (294) of the loose joint 260 (262), the alarm triggering time is changed from the time set for actuating the alarm.

In this embodiment, even when the alarm setting cam 258 rotates with the protrusion 246 (248) not in contact with the wall surface 292 (294) of the loose joint 260 (262) as described above, accurate alarm setting can be performed. That is, when it becomes immediately before the time set to give the alarming, as is shown in FIG. 18 (A), the projection 280 (282) provided in the alarm finger 264 (266) engages with the recess 288 (290). At this time, the frictional force between the alarm setting wheel 238 and the alarm setting cam 258 becomes greater than the frictional force between the alarm intermediate wheel 244 and the alarm setting cam 258. Therefore, as shown in FIG. 18 (B), the alarm intermediate wheel 244 rotates until the protrusion 246 (248) contacts the wall surface 292 (294) of the loose joint 260 (262), while the alarm setting cam 258 remains stationary. Then when the time set for triggering the alarming operation occurs, the alarm intermediate wheel 244 rotates intermittently from the state shown in FIG. 18 (B). At this time, as shown in FIG. 18 (C), the alarm setting cam 258 rotates being pressed by the protrusion 246 (248) of the alarm intermediate wheel 244. Meantime, the projection 280 (282) of the alarm finger 264 (266) climbs up from the recess 288 (290) of the alarm setting wheel 238 by way of the slope formed in the projection 280 (282). Then, as is shown in FIG. 18 (D), the alarm setting cam 258 rotates until the end of the projection 280 (282) reaches to the depressing surface 284 (286) of the engaging portion 240 (242) of the alarm setting wheel 238, that is, to the alarm setting time position indicated by the dotted line 300. As a result, as shown in FIG. 18 (E), the alarm finger 264 (266) of the alarm setting cam 258 drops into the engaging portion 240 (242) of the alarm setting wheel 238 via the depression 272 (274). At this time, the movable contact plate 268 comes into contact with the fixed contact plate 270. As a result, the alarm operation circuits, such as alarm circuit, timer circuit, which are connected to these contact plates 268 and 270 are actuated. Thereafter, when the alarm intermediate wheel 244 continues the intermittent rotation, the alarm setting cam 258 rotates being pressed by the protrusion 246 (248) of the alarm intermediate wheel 244. At the same time, the alarm finger 264 (266) returns to the gear surface from the engaging portion 240 (242) of the alarm setting wheel 238, by way of the shoulder 276 (278). At this time, the alarm setting wheel 238 presses the movable contact plate 268 against its spring force. Consequently, both the contact plates 268 and 270 are released from contact, and the alarming operation is completed.

As described above, in this embodiment, as shown in FIG. 18 (B), immediately before the time set for alarming is reached, the condition wherein the protrusion 246 (248) of the alarm intermediate wheel 244 is pressed towards the wall surface 292 (294) of the loose joint 260 (262) of the alarm setting cam 258 can be achieved by means of the engagement between the projection 280 (282) and the recess 288 (290). Therefore, as shown in FIG. 18 (D), high precision in alarm setting can be obtained.

In addition, because the alarm intermediate wheel 244 rotates intermittently by interlocking with the wheel train of timepiece, the depressing operation as shown in FIG. 18 (E) can be performed by means of the one intermittent rotation of the alarm intermediate wheel 244 when the time set for alarming occurs with the state as shown in FIG. 18 (B). Thus, further precise alarm setting can be performed.

In this embodiment, the foregoing recess 288 is formed to be relatively shallow, in order to facilitate the disengagement between the projection 280 and the recess 288 by the manual operation performed with relatively high speed and relatively strong rotational force in a counterclockwise rotation of the alarm intermediate wheel 244.

In the embodiment described above, the projection 280 (282) is provided at a location adjacent to the depression 272 (274) at the top of the alarm finger 264 (266) of the alarm setting cam 258. Also, in the same embodiment, the recess 288 (290) that can engage with the projection 280 (282) is provided at a location adjacent to the the depression 284 (286) of the engaging portion 240 (242) of the alarm setting wheel 238. However, it may be constructed also as described below. That is, the projection could be provided at a location adjacent to the depression 284 (286), so that, by the engagement between the projection and the alarm finger 264 (266) of the alarm setting cam 258, the projection 246 (248) of the alarm intermediate wheel 244 is pressed towards the wall surface 292 (294) of the loose joint 260 (262) of the alarm setting cam 258. In this case, it is necessary to set the spring force of the movable contact plate 268 to have the following effect. That is, the frictional force between the alarm setting wheel 238 and the alarm setting cam 258, depending on the engagement between the alarm finger 264 (266) and the projection, must be stronger than the frictional force between the alarm intermediate wheel 244 and the alarm setting cam 258.

Also, it may be constructed as follows. That is, the engaging portion 240 (242) and the recess 288 (290) of the alarm setting wheel 238 can be provided in the alarm setting cam 258, while the alarm finger 264 (266) of the alarm setting cam 258 can be formed in the alarm setting wheel 238. Furthermore, it is also possible to use the following construction. That is, the loose joint 260 (262) of the alarm setting cam 258 can be provided in the alarm intermediate wheel 244, while the protrusion 246 (248) of the alarm intermediate wheel 244 can be provided in the alarm setting cam 258.

As has been described in detail in the above, according to the present invention, the lowering of the alarm setting precision due to the one side drop phenomenon wherein only one of the alarm fingers drops into the engaging portion, etc. can be prevented. Also, the alarm setting time, etc. can be adjusted by both clockwise and counterclockwise rotation of the axle for adjusting the alarm setting wheel. Furthermore, because the alarm triggering operation of the alarm finger is performed in the state wherein the protrusion of the alarm setting cam is pressed and comes into contact with the wall surface of the loose joint of the hour hand wheel, remarkably high precision alarm setting can be obtained. Moreover, the present invention contributes to bring about economical effects. For example, with this simple structure, the lowering in the alarm setting precision due to the use over long periods of time can be prevented. Also, its manufacturing costs can be cut down significantly.

We claim:

1. An alarm setting device for a timepiece comprising:

an alarm intermediate wheel that is assembled in a wheel train of a timepiece and is interlocked with time hands;

an alarm setting wheel held by a main plate coaxially with said alarm intermediate wheel in a freely rotatable manner, and which serves to set an alarm triggering time;

an alarm setting cam that is disposed coaxially with and between said alarm intermediate wheel and alarm setting wheel and being rotatable by being drawn by the alarm intermediate wheel, said alarm setting cam further being freely movable in an axial direction;

a loading spring for pressing the alarm setting cam toward the alarm setting wheel;

wherein:

on one side of said alarm setting cam which faces the alarm intermediate wheel, at least one protrusion is provided, while on the other side thereof that faces the alarm setting wheel, at least two alarm engaging portions are provided;

on one side of said alarm intermediate wheel that faces the alarm setting cam, at least one loose joint for engaging with said protrusion of the alarm setting cam is provided, and this loose joint is longer in its length in a circumferential direction than that of the protrusion of the alarm setting cam in order to drive the alarm setting cam to rotate by dragging said alarm setting cam, thereby making it possible for the protrusion to rotate along the circumferential direction for a predetermined extent within the loose joint;

on one side of the foregoing alarm setting wheel that faces the alarm setting cam, at least two alarm fingers for moving the alarm setting cam towards the axial direction during the alarming operation by engaging with said engaging portions of the alarm setting cam are provided;

said alarm fingers and the engaging portions which are provided on the mutually facing surfaces of the alarm setting cam and the alarm setting wheel each are provided with a sloped depression and a sloped shoulder for making it possible to effect the alarm setting operation in a clockwise as well as in a counterclockwise direction; and a projection and a recess that can be engaged with said projection are formed, adjacent to said depression on top of the alarm finger and adjacent to the depression of the corresponding engaging portion, and upon engagement of the projection with the recess, the protrusion of the alarm setting cam is pressed against a wall surface of the loose joint of the alarm intermediate wheel, whereby the alarm intermediate wheel and the alarm setting cam are securely engaged at the time of triggering the alarming operation and high precision in alarm setting is achieved.

2. An alarm setting device for a timepiece as set forth in claim 1, characterized in that the alarm intermediate wheel is formed of an hour hand wheel, and the alarm setting wheel is formed of an alarming wheel.

3. An alarm setting device as set forth in claim 1, characterized in that it comprises:

the first alarm setting cam mechanism comprises:

an alarm intermediate wheel formed of the first alarm intermediate wheel that rotates at higher speed than the hour hand wheel; and an alarm setting wheel formed of the first alarm setting wheel that is interlocked with an axle for adjusting the alarm setting wheel;

the second alarm setting cam mechanism comprises:

a second alarm intermediate wheel that rotates through interlocking with the first alarm intermediate wheel of the first alarm setting cam mechanism; and a second alarm setting wheel that is disposed coaxially with said second alarm intermediate wheel, and rotates through interlocking with the axle for adjusting the alarm setting wheel; and wherein said second alarm intermediate wheel and second alarm setting wheel are provided with alarm fingers and engaging portions for engaging together, a movable contact plate that spring presses the first alarm setting wheel and the second alarm intermediate wheel towards the alarm setting cam and the second alarm setting wheel, respectively; and a fixed contact plate that is disposed and fixed in a manner to be able to contact with and to detach from said movable contact plate;

wherein when both alarm setting cam mechanisms are actuated to trigger an alarming operation, said fixed contact plate and said movable contact plate mutually come into contact.

4. An alarm setting device as set forth in claim 1, wherein the alarm intermediate wheel is driven intermittently through interlocking with a wheel train of a timepiece.

5. An alarm setting device as set forth in claim 1, 2, 3, or 4, wherein the recess provided in the engaging portion is formed to be relatively shallow in depth in order to facilitate the disengagement between said recess and the projection corresponding to this recess, during the reverse rotation of the alarm intermediate wheel.

* * * * *